United States Patent [19]

Pancheri et al.

[11] Patent Number: 4,810,413

[45] Date of Patent: Mar. 7, 1989

[54] PARTICLES CONTAINING AMMONIUM SALTS OR OTHER CHLORINE SCAVENGERS FOR DETERGENT COMPOSITIONS

[75] Inventors: Eugene J. Pancheri, Montgomery; Eugene S. Sadlowski; Joseph M. Wong, both of Cincinnati; Vincent C. Hand, Oxford; Ann M. Sack, Cincinnati, all of Ohio

[73] Assignee: The Procter & Gamble Company, Cincinnati, Ohio

[21] Appl. No.: 55,815

[22] Filed: May 29, 1987

[51] Int. Cl.[4] ..... C11D 7/42; C11D 3/386

[52] U.S. Cl. ..... 252/174.12; 252/105; 252/174; 252/174.13; 252/174.21; 252/174.17; 252/DIG. 12; 435/188

[58] Field of Search ..... 252/174.12, 174.25, 252/105, 174.13, 174.21, 174.17; 435/188

[56] References Cited

U.S. PATENT DOCUMENTS

| | | | |
|---|---|---|---|
| 3,634,266 | 1/1972 | Thiele et al. | 252/132 |
| 3,741,901 | 6/1973 | Ziffer | 252/132 |
| 4,707,287 | 11/1987 | Herdeman | 252/91 |

FOREIGN PATENT DOCUMENTS

| | | |
|---|---|---|
| 0206417 | 12/1986 | European Pat. Off. . |
| 0765063 | 6/1934 | France . |
| 62-57492 | 3/1987 | Japan . |
| 63-017996 | 1/1988 | Japan . |
| 63-041596 | 2/1988 | Japan . |
| 1417840 | 2/1972 | United Kingdom . |
| 2081295 | 1/1981 | United Kingdom . |

*Primary Examiner*—Paul Lieberman
*Assistant Examiner*—John F. McNally
*Attorney, Agent, or Firm*—Robert B. Aylor; Donald E. Hasse; Thomas H. O'Flaherty

[57] ABSTRACT

Granular detergent compositions contain a low level of ammonium salt or salt of specific anion chlorine scavenger which is preferably protected in a particle. Such salts protect enzymes in the wash process. The preferred particles can also comprise, e.g., a suds-controlling silicone material which is substantially removed from contact with the surfactant component or alkaline component of the composition. The particles preferably use, e.g., a polyethylene glycol carrier, with preferably a small amount of fatty acid, in an irregularly shaped particle having a minimum dimension of at least about 0.05 cm.

8 Claims, No Drawings

PARTICLES CONTAINING AMMONIUM SALTS OR OTHER CHLORINE SCAVENGERS FOR DETERGENT COMPOSITIONS

TECHNICAL FIELD AND BACKGROUND ART

The present invention relates to detergent compositions containing as an essential ingredient a low level of an ammonium salt or other specific chlorine scavengers which are stable on storage. The concept of "stability" as used herein is in the context of protecting the ammonium salt or other specific chlorine scavenger and preserving, maintaining or promoting its capability of inactivating free chlorine in the wash water to protect enzymes. More specifically, the invention in its broadest context encompasses detergent compositions comprising an enzyme component that can be inactivated by free chlorine and a low level of a protected chlorine scavenger that will protect the enzyme from chlorine remaining in the wash water.

Chlorine is used in many parts of the world to purify water. To make sure that the water is safe, a small residual amount of chlorine is left in the water. It has been found that even this small amount of chlorine significantly harms the beneficial effect of the available enzyme components in detergent compositions. See, e.g., U.S. Pat. No. 3,755,085, Tivin et al, incorporated herein by reference.

SUMMARY OF THE INVENTION

The present invention encompasses granular detergent compositions comprising:

(a) an enzyme component that is inactivated by chlorine;

(b) a chlorine scavenger selected from the group consisting of salts containing ammonium cations; sulfite, bisulfite, thiosulfite, thiosulfate, carbamate and ascorbate anions or mixtures thereof, preferably an ammonium salt, that will control at least a substantial portion of the residual chlorine typically found in water used for laundry, said chlorine scavenger being releasably incorporated in particles comprising a water-soluble or water dispersible, substantially non-surface active, detergent-impermeable, and non-hygroscopic carrier, said particles being preferably irregularly shaped and having a minimum dimension of not less than about 0.05 cm and a maximum dimension at least about 20% greater than the minimum dimension; and (c) the balance consisting essentially of detergent components selected from the group consisting of anionic, nonionic, zwitterionic, ampholytic, and cationic detergents, detergent builders, inert materials, detergent adjuvants, and mixtures thereof and said compositions being essentially free of bleaching agents.

The chlorine scavenger of the instant compositions is employed herein in a "chlorine controlling amount". By "chlorine controlling amount" is meant that the formulator of the compositions can select an amount of this component which will control the free chlorine in the feed water to the extent desired. The amount of chlorine scavenging material needed will vary, but only a small amount is used to avoid destroying hypochlorite bleach that is added deliberately to treat bleach sensitive stains.

DETAILED DESCRIPTION OF THE INVENTION

The compositions of the present invention comprise three essential components, the enzyme component, the protected chlorine scavenger, and the detergent additives. The individual components of the compositions herein are described in detail, below.

The Enzyme Component

Enzyme particles are commercially available from a variety of sources. Suitable enzyme particles are the "T-Granulate" and Savinase, sold by NOVO Industries A/S, Bagsvard, Denmark. Other suitable enzymes include Maxacal and Maxatase, sold by Gist-Brocades. Proteases, amylases, lipases, cellulases and mixtures thereof can be used.

The enzyme level should be from about 0.01% to about 5%, preferably from about 0.1% to about 2.5%, most preferably from about 0.2% to about 1%. Proteases are used at an Activity Unit (Anson Unit) level of from about 0.0001 to about 0.1, preferably from about 0.001 to about 0.05, most preferably from about 0.002 to about 0.02, and amylases are used at an amylase unit level of from about 5 to about 5,000, preferably from about 50 to about 500 per gram of detergent composition.

The chlorine scavengers should not be used in a large excess since they will interfere with normal hypochlorite bleaches when such bleaches are added to the wash liquor. The level should be from about 0.01% to about 10%, preferably from about 0.05% to about 5%, most preferably from about 0.08 to about 2%, based on the amount equivalent to from about 0.5 to about 2.5, preferably about 1, ppm of available chlorine, per average use. If both the cation and the anion react with chlorine, which is desirable, the level is adjusted to react with an equivalent amount of available chlorine. Suitable chlorine scavenger anions are selected from the group consisting of reducing materials like sulfite, bisulfite, thiosulfite, thiosulfate, iodide, etc. and antioxidants like carbamate, ascorbate, etc. and mixtures thereof. Conventional non-chlorine scavenging anions like sulfate, bisulfate, carbonate, bicarbonate, nitrate, chloride, borate, phosphate, condensed phosphate, acetate, benzoate, citrate, formate, lactate, salicylate, etc. and mixtures thereof can be used with ammonium cations.

Although the preferred ammonium salts can be simply admixed with the detergent composition, they are prone to adsorb water and/or give off ammonia gas. Accordingly, it is better if they are protected in a particle like that described in U.S. Pat. No. 4,652,392, Baginski et al. Said patent being incorporated herein by reference. The preferred ammonium salts or other salts of the specific chlorine scavenger anions can either replace the suds controlling agent or be added in addition to the suds controlling agent.

Suds Controlling Component

The suds controlling component which is optionally in the particles comprises a silicone suds controlling agent which is incorporated in a water-soluble or water-dispersible, substantially nonsurface active, detergent-impermeable and, non-hygroscopic carrier material. The carrier material contains within its interior substantially all of the silicone suds controlling agent and effectively isolates it from (i.e., keeps it out of contact with) the detergent component of the compositions. The carrier material is selected such that, upon admixture with water, the carrier matrix dissolves or disperses to release the silicone material to perform its suds controlling function.

The silicone materials employed as the suds controlling agents herein can be alkylated polysiloxane materials of several types, either singly or in combination with various solid materials such as silica aerogels and xerogels and hydrophobic silicas of various types, In industrial practice, the term "silicone" has become a generic term which encompasses a variety of relatively high molecular weight polymers containing siloxane units and hydrocarbyl groups of various types. In general terms, the silicone suds controllers can be described as siloxanes having the general structural backbone.

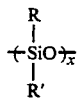

wherein x is from about 20 to about 2,000, and R and R' are each alkyl or aryl groups, especially methyl, ethyl, propyl, butyl or phenyl. The polydimethylsiloxanes (R and R' are methyl) having a molecular weight within the range of from about 200 to about 200,000, and higher, are all useful as suds controlling agents. Silicone materials are commercially available from the Dow Corning Corporation under the trade name Silicone 200 Fluids. Suitable polydimethylsiloxanes have a viscosity of from about 20 cs to about 60,000 cs, preferably from about 20–1500 cs, at 250° C. when used with silica and/or siloxane resin.

Additionally, other silicone materials wherein the side chain groups R and R' are alkyl, aryl, or mixed alkyl and aryl hydrocarbyl groups exhibit useful suds controlling properties. These materials are readily prepared by the hydrolysis of the appropriate alkyl, aryl or mixed alkaryl or aralkyl silicone dichlorides with water in the manner well known in the art. As specific examples of such silicone suds controlling agents useful herein there can be mentioned, for example, diethyl polysiloxanes; dipropyl polysiloxanes; dibutyl polysiloxanes; methylethyl polysiloxanes; phenylmethyl polysiloxanes; and the like. The dimethyl polysiloxanes are particularly useful herein due to their low cost and ready availability.

The silicone "droplets" in the carrier matrix should be from about 1 to about 50 microns, preferably from about 5 to about 40 microns, more preferably from about 5 to about 30 microns in diameter for maximum effectiveness. Droplets below about 5 microns in diameter are not very effective and above about 30 microns in diameter are increasingly less effective. Similar sizes are required for the other silicone suds controlling agents disclosed hereinafter.

A second highly preferred type of silicone suds controlling agent useful in the compositions herein comprises a mixture of an alkylated siloxane of the type hereinabove disclosed and solid silica. Such mixtures of silicone and silica can be prepared by affixing the silicone to the surface of silica ($SiO_2$), for example by means of the catalytic reaction disclosed in U.S. Pat. No. 3,235,509 incorporated herein by reference. Suds controlling agents comprising mixtures of silicone and silica prepared in this manner preferably comprise silicone and silica in a silicone:silica ratio of from about 19:1 to about 1:2, preferably from about 10:1 to about 1:1. The silica can be chemically and/or physically bound to the silicone in an amount which is preferably about 5% to about 20%, preferably from about 10 to about 15%, by weight, based on the silicone. The particle size of the silica employed in such silica/silicone suds controlling agents should preferably be not more than about 1000, preferably not more than about 100 millimicrons, preferably from about 5 millimicrons to about 50 millimicrons, more preferably from about 10 to about 20 millimicrons, and the specific surface area of the silica should exceed about 5 $m^2/g$., preferably more than about 50 $m^2/g$.

Alternatively, suds controlling agents comprising silicone and silica can be prepared by admixing a silicone fluid of the type hereinabove disclosed with a hydrophobic silica having a particle size and surface area in the range disclosed above. Any of several known methods may be used for making a hydrophobic silica which can be employed herein in combination with a silicone as the suds controlling agent. For example, a fumed silica can be reached with a trialkyl chlorosilane (i.e., "silanated") to affix hydrophobic trialkylsilane groups on the surface of the silica. In a preferred and well known process, fumed silica is contacted with trimethylchlorosilane and a preferred hydrophobic silanated silica useful in the present compositions is prepared.

In an alternate procedure, a hydrophobic silica useful in the present compositions is obtained by contacting silica with any of the following compounds: metal, ammonium and substituted ammonium salts of long chain fatty acids, such as sodium stearate, aluminum stearate, and the like; silylhalides, such as ethyltrichlorosilane, butyltrichlorosilane, tricyclohexylchlorosilane, and the like; and long chain alkyl amines or ammonium salts, such as cetyl trimethyl amine, cetyl trimethyl ammonium chloride, and the like.

A preferred suds controlling agent herein comprises a hydrophobic silanated (most preferably trimethylsilanated) silica having a particle size in the range from about 10 millimicrons to about 20 millimicrons and a specific surface area above about 50 $m^2/g$ intimately admixed with a dimethyl silicone fluid having a molecular weight in the range of from about 500 to about 200,000, at a weight ratio of silicone to silanated silica of from about 10:1 to about 1:2. Such suds controlling agents preferably comprise silicone and the silanated silica in a weight ratio of silicone:silanated silica of from about 10:1 to about 1:1. The mixed hydrophobic silanated (especially trimethylsilanated) silica-silicone suds controlling agents provide suds control over a broad range of temperatures, presumably due to the controlled release of the silicone from the surface of the silanated silica.

Another type of suds control agent herein comprises a silicone material of the type hereinabove disclosed sorbed onto and into a solid. Such suds controlling agents comprise the silicone and solid in a silicone:solid ratio of from about 20:1 to about 1:20, preferably from about 5:1 to about 1:1. Examples of suitable solid sorbents for the silicones herein include clay, starch, kieselguhr, Fuller's Earth, and the like. The alkalinity of the solid sorbents is of no consequence to the compositions herein, inasmuch as it has been discovered that the silicones are stable when admixed therewith. As disclosed hereinabove, the sorbent-plus-silicone suds controlling agent must be coated or otherwise incorporated into a carrier material of the type hereinafter disclosed to effectively isolate the silicone from the detergent component of the instant compositions.

Yet another preferred type of silicone suds controlling agent herein comprises a silicone fluid, a silicone resin and silica. The silicone fluids useful in such suds controlling mixtures are any of the types hereinabove disclosed, but are preferably dimethyl silicones. The silicone "resins" used in such compositions can be any alkylated silicone resins, but are usually those prepared from methylsilanes. Silicone resins are commonly described as "three-dimensional" polymers arising from the hydrolysis of alkyl trichlorosilanes, whereas the silicone fluids are "two-dimensional" polymers prepared by the hydrolysis of dichlorosilanes. The silica components of such compositions are microporous materials such as the fumed silica aerogels and xerogels having the particle sizes and surface areas hereinabove disclosed.

The mixed silicone fluid/silicone resin/silica materials useful in the present compositions can be prepared in the manner disclosed in U.S. Pat. No. 3,455,839. These mixed materials are commercially available from the Dow Corning Corporation. According to U.S. Pat. No. 3,455,839, such materials can be described as mixtures consisting essentially of:

for each 100 parts by weight of a polydimethylsiloxane fluid having a viscosity in the range from 20 cs. to 1500 cs. at 25° C., (a) from about 5 to about 50, preferably from about 5 to about 20, parts by weight of a siloxane resin composed of $(CH_3)_3SiO_{\frac{1}{2}}$ units and $SiO_2$ units in which the ratio of the $(CH_3)_3SiO_{\frac{1}{2}}$ units to the $SiO_2$ units is within the range of from about 0.6/1 to about 1.2/1; and (b) from about 1 to about 10, preferably from about 1 to about 5, parts by weight of a solid silica gel, preferably an aerogel.

Again, such mixed silicone/silicone resin/silica suds controlling agents must be combined with a detergent-impermeable carrier material to be useful in the compositions herein.

All of the above patents are incorporated herein by reference.

The ammonium salt and the optional suds controlling agent are preferably incorporated within (i.e., coated, encapsulated, covered by, internalized, or otherwise substantially contained within) a substantially water-soluble, or water-dispersible, and non-hygroscopic carrier material which must be impermeable to detergents and alkalinity and which, itself, should be substantially nonsurface active if the suds controlling agent is present. By substantially nonsurface active is meant that the carrier material, itself, does not interact with the silicone material in such fashion that the silicone material is emulsified or otherwise excessively dispersed prior to its release in the wash water. i.e., the particle size of the silicone droplet should be maintained above about 1, more preferably above about 5 microns.

Of course, when preparing a dry powder or granulated detergent composition, it is preferable that the particles be substantially dry and nontacky at ambient temperatures. Accordingly, it is preferred herein to use as the carrier material, or vehicle, plastic, organic compounds which can be conveniently melted, admixed with the ammonium salt, and thereafter cooled to form solid flakes. There are a wide variety of such carrier materials useful herein. Since the ammonium salt is to be releasably incorporated in the carrier, such that the salt is released into the aqueous bath upon admixture of the composition therewith, it is preferred that the carrier material be water soluble. However, water-dispersible materials are also useful, inasmuch as they will also release the salt upon addition to an aqueous bath.

A wide variety of carrier materials having the requisite solubility/dispersibility characteristics and the essential features of being substantially non-surface active, substantially non-hygroscopic and substantially detergent-impermeable are known. However, polyethylene glycol (PEG) which has substantially no surface active characteristics is highly preferred herein. PEG, having molecular weights of from about 1,500 to about 100,000, preferably from about 3,000 to about 20,000, more preferably from about 5,000 to about 10,000 can be used.

Surprisingly, highly ethoxylated fatty alcohols such as tallow alcohol condensed with at least about 25 molar proportions of ethylene oxide are also useful herein. Other alcohol condensates containing extremely high ethoxylate proportions (about 25 and above) are also useful herein. Such high ethoxylates apparently lack sufficient surface active characteristics to interact or otherwise interfere with the desired suds control properties of the silicone agents herein. A variety of other materials useful as the carrier agents herein can also be used, e.g., gelatin; agar; gum arabic; and various algae-derived gels.

A potential carrier material is a mixture of from about 0.2% to about 15%, preferably from about 0.25% to about 5%, more preferably from about 0.25% to about 2% of fatty acids containing from about 12 to about 30, preferably from about 14 to about 20, more preferably from about 14 to about 16, carbon atoms and the balance PEG. Such a carrier material gives a more desirable suds pattern over the duration of the washing process when the suds controlling agent is present, providing more suds at the start and less suds at the end than PEG alone. The fatty acid delays the solubility of the suds suppressor particle and thereby delays the release of the silicone. This is not preferred for the ammonium salt which should be available as soon as possible.

The irregularly shaped particles of the present invention can be conveniently prepared in a highly preferred flake form by admixing the ammonium salt, etc. with a molten carrier material, mixing to form the appropriate silicone droplet size if the silicone is present, and flaking, e.g., by milling or extruding to form a thin sheet, cooling to solidify the carrier material, and breaking the sheet into particles of the right size. In another preferred process thin films can be formed by cooling molten carrier material with the suds suppressor dispersed therein on, e.g., a chill roll or belt cooler and then breaking said film into appropriate sized flakes. The thickness of the flake should be from about 0.04 to about 0.15 cm, preferably from about 0.05 to about 0.1 cm. When this procedure is used, the ammonium salt is contained within the carrier material so effectively that when this material is eventually admixed with, or incorporated into, a detergent composition, the salt does not substantially come into contact with the detergent surfactant ingredient.

In order to provide a granular, nontacky particle useful in dry granular detergent compositions, the flake should be substantially solidified. This can be achieved by use of belt coolers which quickly cool the sheets or flakes such that the carrier melt is hardened. Extrusion techniques can also be used.

It is to be recognized that the amount of carrier used to isolate the ammonium salt herein from the detergent component of the compositions herein is not critical. It is only necessary that enough carrier be used to provide sufficient volume that substantially all the salt can be incorporated therein. Likewise, it is preferred to have sufficient carrier material to provide for sufficient strength of the resultant granule to resist premature breakage. Generally, above about a 2:1, preferably from about 5:1 to about 100:1, more preferably from about 8:1 to about 40:1, weight ratio of carrier to ammonium salt is employed.

The present invention preferably encompasses detergent compositions comprising a detergent component and an irregularly shaped particle, preferably a flake, the flake consisting essentially of from about 1% to about 30%, preferably from about 1% to about 20%, most preferably about 2% to about 15%, by weight of ammonium salt or other chloride scavenger of any of the types hereinabove disclosed and the remainder being primarily a carrier material of the type hereinabove disclosed.

The size of the particles of the suds controlling component used in the present compositions is selected to be compatible with the remainder of the detergent composition. The suds controlling components herein do not segregate unacceptably within the detergent composition. In general, particles with a maximum dimension of from about 600 to about 2000, preferably from about 800 to about 1600 microns are compatible with spray-dried detergent granules. Therefore, the majority of the particles should have these maximum dimensions. The majority of the particles should have a ratio of the maximum to the minimum diameter of from about 1.15:1 to about 5:1, preferably from about 1.5:1 to about 4:1.

Detergent compositions comprising the ammonium salt and the detergent component can be provided having various ratios and proportions of these two materials. Of course, the amount of the ammonium salt can be varied, depending upon the level of residual chlorine expected by the formulator. Moreover, the amount of detergent component can be varied to provide either heavy-duty or light-duty products, as desired. This invention relates primarily to detergent compositions that contain essentially no additional ingredients which are chlorine scavengers. For example, the other materials present should not provide any substantial additional amounts of ammonium cations.

For most purposes, it is preferred to use a sufficient amount of the silicone suds controlling component in the detergent composition to provide a concentration of from about 0.0005% to about 10% by weight of the silicone suds controlling agent in the composition. A preferred amount of silicone suds controlling agent in the detergent composition lies within the range of from about 0.01% to about 0.5% by weight. Accordingly, the amount of suds control component will be adjusted, depending upon the amount of silicone suds control agent contained therein, to provide these desirable percentages of suds control agent.

Detergent Additives

The amount of the detergent surfactant component can, as noted hereinabove, vary over a wide range which depends on the desires of the user. In general, the compositions contain from about 5% to about 50%, preferably from about 10% to about 30% by weight, of detergent.

The detergent compositions of the instant invention can contain all manner of organic, water-soluble detergent surfactant compounds. A typical listing of the classes and species of detergent compounds useful herein appear in U.S. Pat. No. 3,664,961, incorporated herein by reference. The following list of detergent compounds and mixtures which can be used in the instant compositions is representative of such materials, but is not intended to be limiting.

Water-soluble salts of the higher fatty acids, i.e., "soaps", are useful as the detergent component of the composition herein. This class of detergents includes ordinary alkali metal soaps such as the sodium, potassium, salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Another class of detergents includes water-soluble salts, particularly the alkali metal salts of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic detergents which form a part of the detergent compositions of the present invention are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkylbenzene sulfonates, in which the alkyl group contains from about 9 to about 15 carbon atoms, in straight chain or branched chain configuration, e.g. those of the type described in U.S. Pat. Nos. 2,220,099 and 2,477,383, incorporated herein by reference. Especially valuable are linear straight chain alkylbenzene sulfonates in which the average of the alkyl groups is about 12 carbon atoms, abbreviated as $C_{12}$ LAS.

Other anionic detergent surfactant compounds herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol ethylene oxide ether sulfate containing from about 1 to about 10 units of ethylene oxide per molecule and wherein the alkyl groups contain about 8 to about 13 carbon atoms.

Water-soluble nonionic synthetic detergent surfactants are also useful as the detergent component of the instant composition. Such nonionic detergent materials can be broadly defined as compounds produced by the condensation of ethylene oxide groups (hydrophilic in nature) with an organic hydrophobic compound, which may be aliphatic or alkyl aromatic in nature. The length of the polyoxyethylene group which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name of "Pluronic". These compounds are formed by condensing ethylene oxide with a hydrophobic base formed by the condensation of propylene oxide with propylene glycol. Other suitable nonionic synthetic detergents include the polyethylene oxide condensates of alkyl phenols, e.g., the condensation products of alkyl phenols having an alkyl group containing from about 6 to about 13 carbon atoms in either a straight chain or branched chain configuration, with ethylene oxide, the said ethylene oxide being present in amounts equal to form about 4 to about 15 moles of ethylene oxide per mole of alkyl phenol.

The water-soluble condensation products of aliphatic alcohols having from about 8 to about 22 carbon atoms, in either straight chain or branched configuration, with ethylene oxide, e.g., a coconut alcohol-ethylene oxide condensate having from about 5 to about 30 moles of ethylene oxide per mole of coconut alcohol, the coconut alcohol fraction having from about 10 to about 14 carbon atoms, are also useful nonionic detergents herein.

Semi-polar nonionic detergent surfactants include water-soluble amine oxides containing one alkyl moiety of from about 10 to 20 carbon atoms and 2 moieties selected from the group consisting of alkyl groups and hydroxyalkyl groups containing from 1 to about 3 carbon atoms; water-soluble phosphine oxide detergents containing one alkyl moiety of from about 10 to 20 carbon atoms and 2 moieties selected from the group consisting of alkyl groups and hydroxyalkyl groups containing from 1 to about 3 carbon atoms; and water-soluble sulfoxide detergents containing one alkyl or hydroxyalkyl moiety of from about 10 to about 20 carbon atoms and a moiety selected from the group consisting of alkyl and hydroxyalkyl moieties of from 1 to about 3 carbon atoms.

Ampholytic detergent surfactants include derivatives of aliphatic or aliphatic derivatives of heterocyclic secondary and tertiary amines in which the aliphatic moiety can be straight chain or branched and wherein one of the aliphatic substituents contains from about 8 to about 18 carbon atoms and at least one aliphatic substituent contains an anionic water-solubilizing group.

Zwitterionic detergent surfactants include derivatives of aliphatic quaternary ammonium, phosphonium and sulfonium compounds in which the aliphatic moieties can be straight chain or branched, and wherein one of the aliphatic substituents contains from about 8 to about 18 carbon atoms and one contains an anionic water-solubilizing group. The quaternary compounds, themselves, e.g. cetyltrimethyl ammonium bromide, can also be used herein.

Other useful detergent surfactant compounds herein include the water-soluble salts of esters of alipha-sulfonated fatty acids containing from about 6 to about 20 carbon atoms in the fatty acid group and from 1 to about 10 carbon atoms in the ester group; water-soluble salts of 2-acyloxy-alkane-1-sulfonic acids containing from about 2 to about 9 carbon atoms in the acyl group and from about 9 to about 20 carbon atoms in the alkane moiety; alkyl ether sulfates containing from about 10 to about 20 carbon atoms in the alkyl group and from about 1 to about 12 moles of ethylene oxide; water-soluble salts of olefin sulfonates containing from about 12 to 20 carbon atoms; and beta-alkyloxy alkane sulfonates containing from about 1 to 3 carbon atoms in the alkyl group and from about 8 to 20 carbon atoms in the alkane moiety.

Preferred water-soluble organic detergent compounds herein include linear alkylbenzene sulfonates containing from about 11 to about 13 carbon atoms in the alkyl group; $C_{10-18}$ alkyl sulfates; the $C_{10-16}$ alkyl glyceryl sulfonates; $C_{10-18}$ alkyl ether sulfates, especially wherein the alkyl moiety contains from about 14 to 18 carbon atoms and wherein the average degree of ethoxylation between 1 and 6; $C_{10-18}$ alkyl dimethyl amine oxides, especially wherein the alkyl group contains from about 11 to 16 carbon atoms; alkyldimethyl ammonio propane sulfonates and alkyldimethyl ammonio hydroxy propane sulfonates wherein the alkyl group in both types contains from 14 to 18 carbon atoms; soaps, as hereinabove defined; and the condensation product of $C_{10-18}$ fatty alcohols with from about 3 to about 15 moles of ethylene oxides.

Specific preferred detergents for use herein include: sodium linear $C_{10-13}$ alkylbenzene sulfonates; sodium $C_{12-18}$ alkyl sulfates; sodium salts of sulfated condensation product of $C_{12-18}$ alcohols with from about 1 to about 3 moles of ethylene oxide; the condensation product of a $C_{10-18}$ fatty alcohols with from about 4 to about 10 moles of ethylene oxide; and the water-soluble sodium and potassium salts of higher fatty acids containing from about 10 to about 18 carbon atoms.

It is to be recognized that any of the foregoing detergents can be used separately herein, or as mixtures. Examples of preferred detergent mixtures herein are as follows.

An especially preferred alkyl ether sulfate detergent component of the instant compositions is a mixture of alkyl ether sulfates, said mixture having an average (arithmetic mean) carbon chain length within the range of from about 12 to 16 carbon atoms, preferably from about 14 to 15 carbon atoms, and an average (arithmetic mean) degree of ethoxylation of from about 1 to 4 moles of ethylene oxide, preferably from about 1 to 3 moles of ethylene oxide.

The detergent compositions of the present invention can contain, in addition to the detergent surfactant, water-soluble or water-insoluble builders such as those commonly taught for use in detergent compositions. Such auxiliary builders can be employed to sequester hardness ions and to help adjust the pH of the laundering liquor. Such builders can be employed in concentrations of from about 5% to about 95% by weight, preferably from about 10% to about 50% by weight, of the detergent compositions herein to provide their builder and pH-controlling functions. The builders herein include any of the conventional inorganic and organic water-soluble builder salts.

Such builders can be, for example, water-soluble salts of phosphates including tripolyphosphates, pyrophosphates, orthophosphates, higher polyphosphates, carbonates, silicates, and organic polycarboxylates. Specific preferred examples of inorganic phosphate builders include sodium and potassium tripolyphosphates and pyrophosphates.

Nonphosphorus-containing materials can also be selected for use herein as builders.

Specific examples of nonphosphorus, inorganic detergent builder ingredients include water-soluble inorganic carbonate, bicarbonate, and silicate salts. The alkali metal, e.g., sodium and potassium, carbonates, bicarbonates, and silicates are particularly useful herein.

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material in Zeolite A and has the formula $$Na_{12}[AlO_2)_{12}\cdot(SiO_2)_{12}\cdot xH_2O$$

wherein x is from about 20 to about 30, especially about 27.

Water-soluble, organic builders are also useful herein. For example, the alkali metal, polycarboxylates are useful in the present compositions. Specific examples of the polycarboxylic builder salts include sodiunm and potassium, salts of ethylenediaminetetraacetic acid, nitrilotriacetic acid, oxydisuccinic acid, mellitic acid, benzene polycarboxylate acid, polyacrylate acid, polymaleic acid, and citric acid.

Other desirable polycarboxylate builders are the builders set forth in U.S. Pat. No. 3,308,067, Diehl, incorporated herein by reference. Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in U.S. Pat. No. 4,144,226, issued Mar. 13, 1979 to Crutchfield et al, and U.S. Pat. No. 4,246,495, issued Mar. 27, 1979 to Crutchfield et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Detergent Adjuvants

The detergent compositions herein can contain all manner of additional materials, detergent adjuvants, commonly found in laundering and cleaning compositions. For example, the compositions can contain thickeners and soil-suspending agents such as carboxymethylcellulose and the like. Various perfumes, optical bleaches, fillers, anticaking agents, fabric softeners and the like can be present in the compositions to provide the usual benefits occasioned by the use of such materials in detergent compositions. It is to be recognized that all such adjuvant materials are useful herein inasmuch as they are compatible and stable in the presence of the isolated silicone suds suppressor.

The compositions herein are essentially free of oxygen bleaching agents, since if they are present, there is no need for the chlorine scavenger. Similarly, there should be no chlorine bleaching agent present since the chlorine scavenger would not be effective against a large amount of available chlorine.

A finished detergent composition of this invention can contain minor amounts of materials which make the product more attractive. The following are mentioned by way of example: a tarnish inhibitor such as benzotriazole or ethylene thiourea can be added in amounts up to 2% by weight; fluorescers, perfumes and dyes, while not essential, can be added in small amounts. An alkaline material such as sodium or potassium carbonate or hydroxide can be added in minor amounts as supplementary pH adjusters. There may also be mentioned, as suitable additives: bacteriostats, bactericides, corrosion inhibitors such as soluble alkali silicates (preferably sodium silicates having an $SiO_2/Na_2O$ ratio of from 1:1 to 2.8:1), and textile softening agents.

All percentages, parts and ratios herein are by weight unless otherwise specified.

The following examples illustrate the compositions herein.

EXAMPLE I

In this example the base detergent composition is a nil-P composition containing about 28% of a mixed anionic/nonionic surfactant system, about 40% of a mixed builder system including hydrated Zeolite A, sodium carbonate, and polycarboxylate detergent builders, about 13% sodium sulfate, and the remainder being water and minors. The composition contains an alkaline protease at a level of about 0.006 activity units per gram of product (Au/gm). The flake containing the chlorine scavenger has a maximum dimension of about 40 microns to about 2,000 microns and contains about 75% polyethylene glycol (PEG) having a molecular weight of about 8,000, about 5% of suds suppressor. Such chlorine scavengers are referred to as "protected", and are indicated by an "*". The indicated percentage of the composition is the named chlorine scavenger in each instance. The wash conditions, unless indicated otherwise, are 95° F. water having a mixed $Ca^{++}/Mg^{++}$ hardness of 7 grains per gallon with 9.7 grams of product in a miniwasher. The free chlorine level is also given. The cleaning results are given in panel score units (PSU) based on a grading system in which 0 is no difference, 1 is "I think I see a difference", 2 is "There is a difference", 3 is "There is a big difference" and 4 is "There is a very big difference".

| | | Test 1 | | | | |
|---|---|---|---|---|---|---|
| | | PSU | | | | |
| | Av.Cl (ppm) | Grass(2) | Gravy | Blood | Chocolate Pudding | Average |
| A. Base Composition | 1 | 0.0 | 0.0 | 0.0 | 0.0 | 0.0 |
| B. Base Composition + 0.3% $NH_4Cl$* | 1 | 2.11 | 1.92 | 1.65 | 1.46 | 1.85 |
| C. Base Composition + 0.3% $(NH_4)_2SO_4$* | 1 | 1.90 | 1.92 | 1.78 | 2.61 | 2.02 |
| D. Base Composition + | 1 | 2.14 | 2.12 | 1.92 | 1.47 | 1.96 |

-continued

| | Av.Cl (ppm) | Test 1 PSU Grass(2) | Gravy | Blood | Chocolate Pudding | Average |
|---|---|---|---|---|---|---|
| 0.3% $Na_2S_2O_3$* E. Base Composition + 0.5% $(NH_4)_2SO_4$* LSD O.27 | 1 | 1.63 | 2.04 | 1.04 | 1.86 | 1.64 |

| | Av.Cl (ppm) | Test 2 PSU Grass(2) | Gravy | Blood | Chocolate Pudding | Average |
|---|---|---|---|---|---|---|
| A. Base Composition | 1 | 0.0 | 0.0 | 0.0 | 0.0 | 0.0 |
| B. Base Composition + 0.6% $(NH_4)_2S_2O_3$ | 1 | 2.37 | 1.81 | 2.36 | 1.81 | 2.14 |
| C. Base Composition + 0.07% $(NH_4)_2S_2O_3$ | 1 | 1.27 | 0.88 | 1.33 | 1.12 | 1.17 |
| D. Base Composition + 0.25% $(NH_4)_2S_2O_3$* | 1 | 2.07 | 1.94 | 2.06 | 1.17 | 1.86 |
| E. Base Composition + 0.5% $Na_2S_2O_3$ LSD 0.30 | 1 | 2.17 | 1.42 | 2.55 | 0.90 | 1.84 |

| | Av.Cl (ppm) | Test 3 PSU Grass(2) | Gravy | Blood | Chocolate Pudding | Average |
|---|---|---|---|---|---|---|
| A. Base Composition + 0.5% $Na_2SO_3$ | 1 | 0.0 | 0.0 | 0.0 | 0.0 | 0.0 |
| B. Base Composition + 0.5% $NaNO_3$ | 1 | −1.48 | −2.09 | −1.32 | −0.88 | −1.45 |
| C. Base Composition + 0.5% $NaNO_2$ | 1 | −1.02 | −1.80 | −2.11 | −0.70 | −1.33 |
| D. Base Composition + 0.5% $(NH_4)_2SO_4$ | 1 | −0.31 | −0.43 | −1.79 | −0.16 | −0.60 |
| E. Base Composition + 0.001% Tungstic Acid LSD 0.32 | 1 | −1.35 | −1.88 | −1.88 | −1.25 | −1.54 |

| | Av.Cl (ppm) | Test 4 PSU Grass(2) | Gravy | Blood | Chocolate Pudding | Average |
|---|---|---|---|---|---|---|
| A. Base Composition | 0 | 0.0 | 0.0 | 0.0 | 0.0 | 0.0 |
| B. Base Composition | 1 | −1.26 | −1.04 | −1.56 | −0.57 | −1.14 |
| C. Base Composition + | 1 | 0.13 | 1.53 | – | | |

-continued

| | Av.Cl (ppm) | Test 4 PSU Grass(2) | Gravy | Blood | Chocolate Pudding | Average |
|---|---|---|---|---|---|---|
| 0.25% $(NH_4)_2SO_4$* | | | | | | |
| D. Base Composition + 0.5% KBr | 1 | −2.00 | −0.33 | −2.18 | −1.33 | −1.57 |
| E. Base Composition + 0.5% Sulfamic Acid | 1 | −0.90 | 0.04 | −1.76 | −0.25 | −0.75 |
| LSD 0.33 | | | | | | |

As can be seen, all of the above levels of chlorine scavengers in Tests 1 and 2 protect the enzyme at this level of residual chlorine and provide a big advantage over the base composition. In Test 3 only the $(NH_4)_2SO_4$ and the $Na_2SO_3$ are effective, and in Test 4 only the ammonium salts are effective. Some of the materials, like $NaNO_2$, tungstic acid, KBr and sulfamic acid that would be expected to provide a benefit, are not effective.

EXAMPLE II

In this example, the base composition is a nil P detergent composition containing essentially the same ingredients as in Example I but with less polycarboxylate builder and more hydrated Zeolite A. The test conditions, unless otherwise indicated, were the same.

| | Av.Cl (ppm) | Test 1 PSU Grass(2) | Gravy | Blood | Chocolate Pudding | Average |
|---|---|---|---|---|---|---|
| A. Base Composition | 0 | 0.0 | 0.0 | 0.0 | 0.0 | 0.0 |
| B. Base Composition | 1 | −2.20 | −1.80 | −1.38 | −2.70 | −2.06 |
| C. Base Composition + 0.5% $Na_2SO_3$ | 1 | −0.06 | −0.29 | −0.24 | −0.85 | −0.20 |
| D. Base Composition + 0.75% $Na_2SO_3$ | 1 | 0.17 | 0.19 | −0.17 | −0.70 | −0.07 |
| LSD 0.35 | | | | | | |

| | Av.Cl (ppm) | Test 2 PSU Grass(2) | Gravy | Blood | Chocolate Pudding | Average |
|---|---|---|---|---|---|---|
| A. Base Composition | 1 | 0.0 | 0.0 | 0.0 | 0.0 | 0.0 |
| B. Base Composition | 0 | 1.27 | 1.54 | 0.59 | 1.95 | 1.32 |
| C. Base Composition + 0.5% BHT (butylated hydroxy toluene) | 1 | 0.28 | 0.28 | 0.51 | −0.24 | 0.22 |
| D. Base Composition + 0.5% $Na_2SO_3$ | 1 | 1.44 | 1.95 | 1.05 | 1.91 | 1.56 |
| LSD 0.42 | | | | | | |

| | Av.Cl (ppm) | Test 3 PSU Grass(2) | Gravy | Blood | Chocolate Pudding | Average |
|---|---|---|---|---|---|---|
| A. Base Composition | 1 | 0.0 | 0.0 | 0.0 | 0.0 | 0.0 |
| B. Base Composition + | 1 | 0.67 | 0.27 | 0.03 | 0.40 | 0.41 |

-continued

| | Av.Cl (ppm) | Test 3 PSU Grass(2) | Gravy | Blood | Chocolate Pudding | Average |
|---|---|---|---|---|---|---|
| 0.5% Guanidine | | | | | | |
| C. Base Composition + 0.5% Gelatin | 1 | 0.50 | 1.14 | 0.28 | 0.68 | 0.62 |
| LSD 0.64 | | | | | | |

| | Av.Cl (ppm) | Test 4 PSU Grass(2) | Gravy | Blood | Chocolate Pudding | Average |
|---|---|---|---|---|---|---|
| A. Base Composition | 1 | 0.0 | 0.0 | 0.0 | 0.0 | 0.0 |
| B. Base Composition + 5% Urea | 1 | −0.60 | −0.48 | −0.02 | −0.59 | −0.46 |
| C. Base Composition + 5% Gelatin | 1 | 1.78 | 1.14 | 0.88 | 0.24 | 1.16 |
| D. Base Composition + 5% Dextrose | 1 | 0.02 | −0.34 | −0.08 | −0.32 | −0.14 |
| LSD 0.46 | | | | | | |

As in Example I, many of the materials that would be expected to react with the free chlorine and protect the enzyme are ineffective. Such materials include butylated hydroxy toluene, guanidine, urea, and dextrose. Gelatin works at higher levels, but not very well at the preferred levels.

EXAMPLE III

In this example, the base detergent composition contains about 10.5% of a mixed anionic detergent surfactant system, about 52% of a mixed sodium tripolyphosphate/sodium carbonate detergent builder system, about 17% sodium sulfate and the balance water and minor ingredients. The composition contains about 0.006 activity units of alkaline protease per gram of detergent composition. The flakes and the washing conditions are the same as in Example I.

| | Av.Cl (ppm) | Test 1 PSU Grass(2) | Gravy | Blood | Chocolate Pudding | Average |
|---|---|---|---|---|---|---|
| A. Base Composition | 1 | 0.0 | 0.0 | 0.0 | 0.0 | 0.0 |
| B. Base Composition | 0 | 2.04 | 1.44 | 1.55 | 0.22 | 1.44 |
| C. Base Composition + 0.5% Ascorbic Acid | 1 | 1.48 | 1.38 | 1.55 | 0.16 | 1.21 |
| D. Base Composition + 0.5% Sodium Thiosulfate | 1 | 1.24 | 1.32 | 1.13 | 0.33 | 1.05 |
| E. Base Composition + 0.5% $Na_2SO_3$ | 1 | 1.52 | 0.86 | 1.41 | 0.08 | 1.08 |
| LSD 0.49 | | | | | | |

| | Av.Cl (ppm) | Test 2 PSU Grass(2) | Gravy | Blood | Chocolate Pudding | Average |
|---|---|---|---|---|---|---|
| A. Base Composition | 0 | 1.70 | 1.48 | 2.21 | 1.16 | 1.65 |
| B. Base | 1 | 0.00 | 0.00 | 0.00 | 0.00 | 0.00 |

-continued

| | Av.Cl (ppm) | Test 2 PSU Grass(2) | Gravy | Blood | Chocolate Pudding | Average |
|---|---|---|---|---|---|---|
| Composition C. Base | 1 | 1.75 | 0.40 | 1.13 | -0.20 | 0.97 |
| Composition + 6.6 ppm $(NH_4)_2SO_4$ D. Base | 1 | 1.63 | 0.95 | 2.19 | 0.07 | 1.29 |
| Composition + 6.6 ppm $NH_4Cl$ E. Base | 1 | 2.06 | 0.82 | 1.88 | -0.35 | 1.29 |
| Composition + 6.6 ppm Tris (hydroxymethyl) amino methane | | | | | | |
| $LSD_{95}$ | 0.55 | | | | | |

Note: Hardness is 5 gpg.

The tris(hydroxymethyl)aminomethane did not protect the enzymes significantly better than the ammonium salts which are easier to make and are therefore less expensive.

What is claimed is:

1. A granular detergent composition comprising:
   a. an enzyme component that is inactivated by free chlorine;
   b. a chlorine scavenger which is a salt containing ammonium cation;
   c. from about 5% to about 50% by weight of detergent surfactant selected from the group consisting of anionic, nonionic, zwitterionic, ampholytic, and cationic detergents, and mixtures thereof; and
   d. from about 5% to about 95% by weight of detergent builder; said composition being essentially free of bleaches; and said ammonium cation being incorporated within a substantially water-soluble, or water-dispersible, and non-hygroscopic carrier material which is impermeable to detergents and alkalinity.

2. The composition of claim 1 wherein said chlorine scavenger is an ammonium salt of sulfate, bisulfate, carbonate, bicarbonate, nitrate, chloride, borate, phosphate, condensed phosphate, acetate, benzoate, citrate, formate, lactate, salicylate, and mixtures thereof.

3. The composition of claim 1 wherein said water-soluble, or water-dispersible, and non-hygroscopic carrier material which is impermeable to detergents and alkalinity is selected from the group consisting of polyethylene glycol, highly ethoxylated fatty alcohols, gelatin, agar, gum arabic, and algae-derived gels.

4. The composition of claim 3 wherein the enzyme is selected from the group consisting of proteases at an activity unit level of from about 0.0001 to about 0.1 per gram of detergent composition, amylases at an amylase unit level of from about 5 to about 5,000 per gram of detergent composition, and mixtures thereof.

5. The composition of claim 4 wherein said enzyme is a protease.

6. The composition of claim 3 wherein said water-soluble, or water-dispersible, and non-hygroscopic carrier material is selected from the group consisting of polyethylene glycol and highly ethoxylated fatty alcohols.

7. The composition of claim 6 wherein said carrier material and said ammonium salt are added to the granular detergent composition as irregularly shaped particles consisting essentially of from about 1% to about 30% by weight of ammonium salt and the remainder being primarily said carrier material.

8. The composition of claim 1 wherein a silicone suds controlling agent is also incorporated in said carrier material.

* * * * *